United States Patent [19]

Toyoshi et al.

[11] Patent Number: 4,821,076

[45] Date of Patent: Apr. 11, 1989

[54] ELECTRO-STATIC PHOTO-COPIER MACHINE

[75] Inventors: Naoki Toyoshi, Toyohashi; Takeki Oka, Toyokawa, both of Japan

[73] Assignee: Minolta Camera Kabushiki Kaisha, Osaka, Japan

[21] Appl. No.: 71,261

[22] Filed: Jul. 8, 1987

[30] Foreign Application Priority Data

Jul. 15, 1986 [JP] Japan ..... 61-167340
Jul. 15, 1986 [JP] Japan ..... 61-167341

[51] Int. Cl.[4] ..... G03G 15/00

[52] U.S. Cl. ..... 355/3 R; 355/3 CH; 355/14 CH

[58] Field of Search ..... 355/3 R, 3 CH, 14 CH, 355/14 R, 3 DD, 14 D; 430/97, 100

[56] References Cited

U.S. PATENT DOCUMENTS 3,967,891 7/1976 Rippstein ..... 355/3 R
4,014,607 3/1977 Cherian ..... 355/3 R

FOREIGN PATENT DOCUMENTS 51-134635 11/1976 Japan .
54-308330 3/1979 Japan .

OTHER PUBLICATIONS

*IBM Technical Disclosure Bulletin,* vol. 12, No. 8, Jan. 1970, Elzinga, "Reversal Development of Large Black Areas in an Electrophotographic Process", p. 1222.

*Primary Examiner*—Arthur T. Grimley
*Assistant Examiner*—J. Pendegrass
*Attorney, Agent, or Firm*—Wenderoth, Lind & Ponack

[57] ABSTRACT

The copying machine of the present invention is capable of executing a reversal image forming mode wherein a toner is only deposited onto a non-image portion of the latent image to visualize. When the reversal image forming mode is designated, a screen member, which is movable to intrude into or extrude from the light path of the exposing means, is controlled to intrude into the light path of the exposing means to form a reversal image.

19 Claims, 15 Drawing Sheets

ELECTRO-STATIC PHOTO-COPIER MACHINE

BACKGROUND OF THE INVENTION

1. Field of the Invention

This invention relates to electro-static photo-copier machines which can operate to produce from positive document images pseudo-reversed one or alternatively from negative document images pseudo-reversed negative one.

2. Description of the Prior Arts

Generally speaking, in the case of the electro-static photo-copying technique, the process for providing positive copy images has been applied. Concerning positive document images (static latent images), a regular developing operation is applied by depositing the toner onto high potential regions on the drum surface, while, concerning negative document images (static latent images), a reverse developing operation is applied by depositing the toner onto low potential regions on the drum surface. It should be noted, however, static polarity and the like of the tone as adopted in the regular deposition mode is different from that adopted in the reverse deposition mode. As the result, in case of the image forming apparatus which is operable selectively one or the other depositing mode, these two differently operable depositing units are arranged in parallel in proximity of the drum surface so as to be capable of executing one selected-out mode only at one time by use of an operation change-over means. Or alternatively, either of the two different depositing units is exchanged in position with another, each time as occasion may desire, which procedure is naturally highly troublesome.

On the other hand, it may naturally be conceived to form negative copy images from positive document images by reliance or the reversing procedure. If a reverse deposition should be executed for this purpose, two different kinds of developing units must be adopted and arranged in order to perform the regular depositing operation as well as now reguisite positive-to-positive copying operation.

It may be further conceived to perform a copy image forming operation with use of negative document images as per se.

If, in this case, the regular depositing mode is employed for this purpose, two different kinds of developer must be employed and arranged again in this case serving for negative-to-positive developing and reverse developing operations.

SUMMRY OF THE INVENTION

An onject of the present invention is to provide an electro-static photo-copier machine capable of providing better quality, toner-fogless, pseudo-reversed images and more specifically from positive document images.

Another object of the invention is to provide an efficient photo-copier of the above kind, capable of providing pseudo-reversed negative images from negative document images.

A still another object is to provide an efficient static photo-copier capable of selectively forming positive or negative images as may be wanted and with use of one and the same developer unit.

A still further object of the invention is to provide an efficient copying machine of the above kind wherein image-forming step can be selectively changed so as to provide regular positive images as well as positive marginal peripheral outline images can be formed, in addition to the foregoing various image forming capabilities.

A still further object of the invention is to provide an improved photo-copier of the above kind, wherein, however, negative document images are subjected to a pseudo-reversing operation to form corresponding negative latent images which are then subjected to a reverse development, so as to provide pseudo-reversed negative images, and wherein further by selective changing of the image-forming mode, if wanted, regular positive image formation or positive marginal image formation can be realized, as occasion may desire.

For fulfilment of any of the foregoing objects, the inventive electro machine, comprising a photo-sensitive means, preferably a rotatable drum; a first static charger for charging surface of said photo-sensitive means at a predetermined potential level; image exposing means for exposing document images onto precharged surface, so as to form thereon corresponding latent images; a screen member for advancing into and receding from exposure light passage; a second static charger for recharging of said static latent images formed by said image exposing means; developing means for development of said static latent images formed at said surface of the photo-sensitive means; mode specifying means for designating operating mode for visualizing non-image areas of said document images by attaching toner exclusively thereonto; and control means for advancing said screen member into said exposure light passage when the mode has been specified for execution of the exposure operation.

BRIEF DESCRIPTION OF THE DRAWING

In the following description, like parts are designated by like reference numerals throughout the several drawings.

FIGS. 1–11 illustrate the first embodiment of the invention and more specifically:

FIG. 1 is a schematic, substantially elevational arrangement view of the first embodiment copying machine according to the invention.

FIG. 3 is a plan view of an operation control panel employed.

FIG. 4 is a block diagram of a control circuitry employed.

FIG. 5 is a somewhat enlarged, substantially elevational view, illustrating a different design and arrangement of the screen member and its related working parts.

FIG. 6 is a schematic and modelized representation of electric lines of force appearing in the second charging step in case of the reverse image formation mode when selection thereof has been made.

FIG. 7, at (*a*)–(*e*), represents latent image potentials appearing in several operation steps of the same operation mode as above.

FIG. 8 represents by way of example only a schematic diagram of electric lines of force appearing in the same operation mode.

FIG. 9, (*a*) and (*b*), represents several schematic graphs of latent image potentials as appearing in the same reverse image formation mode and only by way of example.

FIG. 10 is a schematic representation of electric lines of force as appearing in the second charging step in the peripheral image formation mode when it has been selected out.

FIG. 1, at (*a*)-(*c*), represents latent image potentials as appearing in several operation steps of the same reverse imae formation mode.

More specifically, FIG. 12 is a schematic representation of electric lines of force appearing in the second charging step of the reverse image formation mode.

FIG. 13, (*a*)-(*b*), represents schematic graphs of latent image potentials as appearing in several operation steps of the same image formation mode as above.

FIG. 14 represents a schematic graph illustrating electric lines of force as appearing in the second charging step in case of the peripheral image forming mode.

FIG. 15, at (*a*)-(*c*), is a graph showing latent image potentials as appearing in several steps of the same operation mode as above.

More specifically, FIG. 16 is a schematic, substantially elevational view of main parts of the copying machine according to the third embodiment.

FIG. 18 is a block diagram showing control circuitry employed therein.

FIG. 19 is a similar view to FIG. 6.

FIG. 20 at (*a*)-(*e*), is a similar view to FIG. 7.

FIG. 21 is a similar view to FIG. 6.

FIG. 22, (*a*) and (*b*), is a similar view to FIG. 9.

FIG. 23 is a similar view to FIG. 6.

FIG. 24, (*a*)-(*c*), is a similar view to FIG. 11.

FIG. 25 is a similar view to FIG. 6.

FIG. 26 is a similar view to FIG. 13.

FIG. 27 is a similar view to FIG. 6.

FIG. 28, (*a*)-(*c*), is a similar view to FIG. 11.

PREFERRED EMBODIMENTS

First Embodiment (refer to FIGS. 1-11)

Figure 1:
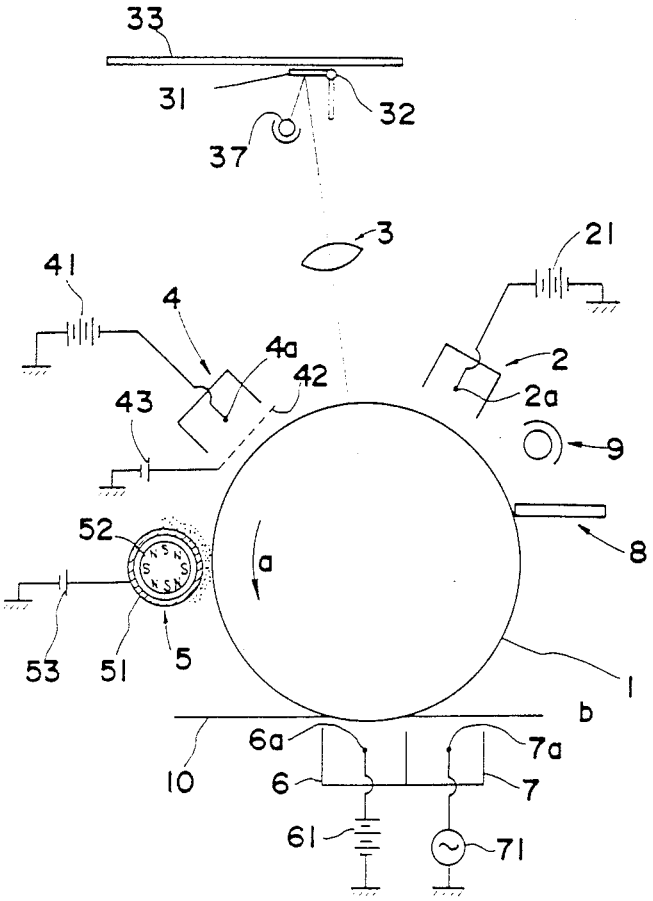

In FIG. 1, illustrating an electronic photocopier embodiment shown only schematically, numeral 1 represents a photosensitive drum rotatably provided in the direction of arrow a and having a photosensitive surface layer, although not shown by virtue of its very popularity. Around the drum 1 at small distances therefrom, following several units and members are provided.

First, numeral 2 represents a first charger which is provided with a charge wire 2*a* electrically connected with a voltage source 21, for execution of first charging step to provide charge of a predetermined potential level onto the surface of the drum 1.

Numeral 3 represents an exposure unit proper which is represented schematically by a condenser lens representatively. More specifically, however, the exposure unit comprises an exposure lamp 37 and lens means and reflector means of conventional design, not shown by virtue of their very popularity, for execution of static latent image forming operation on the drum surface in correspondence to the images on the document in accordance with the conventional slit exposure technique. Numeral 33 represents a transparent document table, a screen 31 being mounted directly below the former pivotably on a pivot 32, so as to appear at or recede from the exposure light passage. Screen 31 consists of a transparent substrate having fine color stripes extending transversely to the document scanning direction. The screen 31 is movable in unison with exposure lamp 37 and advances in case of the reverse image formation mode into the exposure light passage so as to provide a specific effect as will be later more fully described, or recedes therefrom in case of the peripheral image formation mode and standard copying mode, as the case may be.

Screen 31 serves for forming a slight potential pattern overall on the background area outside of the static latent images formed on the drum surface during the reverse image forming mode if it has been preselected.

As shown schematically in FIG. 1, if the operating mode is such that the screen 31 is positioned within the exposure light passage and it is shifted in parallel with the document, the direction of line pattern on the line screen 31' must be positioned at right angles to the document scanning direction for the prevention of otherwise frequently occurring defective image formation.

Figure 2A:
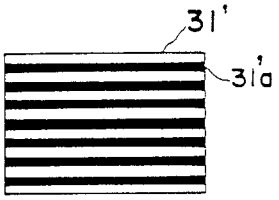
FIGS. 2*a* and 2*b* represents plan view of two different modes of a screen member.
Figure 2B:
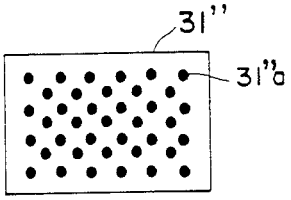
Figure 5:
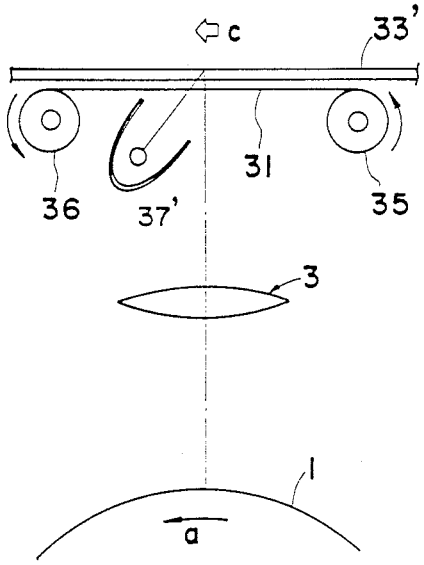

In such a case, where the line screen 31' is equally used and, however the pattern direction is directed in the same direction as the document scanning one, or a mesh screen 31'' as shown in FIG. 2*b* is utilized, the following two different methods may be deemed to employ for the prevention of defective image formation caused by the screen pattern. As the first method, the screen is positioned between the document and the glass table 33. As the second method, as schematically shown in FIG. 5, the document table 33 is movably arranged as hinted by a small double line arrow "c", while the screen 31' is tensioned between a delivery drum 35 and a wind-up drum 36 and movable in synchronism with the table 33'.

In this case, as shown in FIG. 2*a*, a screen 31'' which is formed with color line parallel stripes 31'*a*, may be used. Or alternatively, a modified screen 31'' which comprises a transparent substrate plate or sheet representing a number of geometrically perforated color mesh dots 31''*a* may equally be used.

More specifically, when the reverse image formation has been preselected in this case, the document table 33' is shifted at a constant speed in the direction c in the exposure period, and the elongated screen 31' or 31'' is moved in unison therewith from delivery drum 35 towards wind-drum 36. Light source 37' may be similar to that which was shown at 37 in FIG. 1. As a result, document images are projected together with the screen pattern 31'*a* or 31''*a* onto the drum surface 1. The screen 31' or 31'' will be rewound from drum 36 to drum 35 during the next succeeding return movement of the table 33, so as to be positioned ready for the next photo-copying operation.

It is most preferable to provide at end or ends of screen member 31' with transparent and patternless area or areas, respectively, so as to execute image exposure operations therethrough in case of the peripheral image formation mode and standard copying mode operation.

In the following description of the present embodiment, it is assumed that the line screen 31' is positioned perpendicular to the document scanning direction, as a representative example. In this case, the line screen may be positioned at any place in the exposure light passage.

Numeral 4 represents a scorotron charger which is adapted for execution of the second charging operation onto the sensitive drum surface 1 which has already been formed with latent images under the action of the exposure unit 3. It's charge wire 4Li a is electrically connected with a voltage source 41, while it's grid 42 is connected to another voltage source 43. Charge wire 4*a* is impressed with a voltage from the source 41 with a d.c. voltage of opposite polarity to that which is supplied to said static charger 2. Grid 42 is impressed from the source 43 with a voltage which is of the same polarity with that applied to static charger 2, and is sufficiently lower than the surface potential at the static latent image areas. Further, it is necessary to set the grid voltage to be lower than the surface potential appearing in the non-image areas relative to the latent images and having been lowered under the action of exposure unit 3.

Numeral 5 represents a developing unit which comprises a developing sleeve 51 fitted insidely with a magnet roller 52 having magnetized N- and S-segments in a alternating manner as conventionally at least on the peripheral zone, for acting in the magnetic brush system. 53 represents a voltage source which is capable of acting as developing bias means and connected to developing sleeve 51 which acts as developing electrode. The developing agent consists of a mixture of magnetic carrier and insulative toner, which constituents are charged by the friction charging to have opposite polarities to each other. The insulative toner is charged to opposite polarity to that prevailing at the static charger 2. The toner may be magnetic or non-magnetic, as the case may be. In the latter case, the sleeve 51 is charged from the source 53 with a developing bias voltage which is of the same polarity to that prevailing at static charger 2 and is somewhat higher than the surface potential appearing at the latent image areas which have been subjected to a potential drop in the second charging step. When the insulative tone is non-magnetic, developing sleeve 51 may be impressed with such a biasing voltage as is somewhat lower than the surface potential prevailing at the static latent image areas and having been subjected to a potential reduction duing the second charging step. It is also possible to impress an improved bias voltage overlapped with alternating voltages. With use of magnetic toner, single use thereof may be allowed.

Numeral 6 represents a transfer charger capable of applying an electric field from behind to copy paper 10 fed in the conveying direction shown by a small arrow b from a supply source, not shown, for the purpose of transfer the toner images previously formed on the photosensive drum surface 1 under the action of developing unit 5. For this purpose, the charge wire 6*a* is charged from voltage source 61 with such a voltage as having opposite polarity to that of insulative toner.

Numeral 7 represents a separation charger which is adapted for applying an alternating electric field for execution of electrical separation of the copy paper 10 from drum surface 1 by removal of residual voltage therefrom. For this purpose, the charge wire 7*a* is energized with alternating voltages from the source 71.

Numeral 8 represents a cleaner unit which operates in the blading-off mode for removal of superfluously residual amount of toner from the drum surface.

Numeral 9 represents an eraser lamp adapted for projecting lights onto the drum surface 1 to remove residual charge therefrom as a preparatory treatment for the next succeeding photo-copying job.

Figure 3:
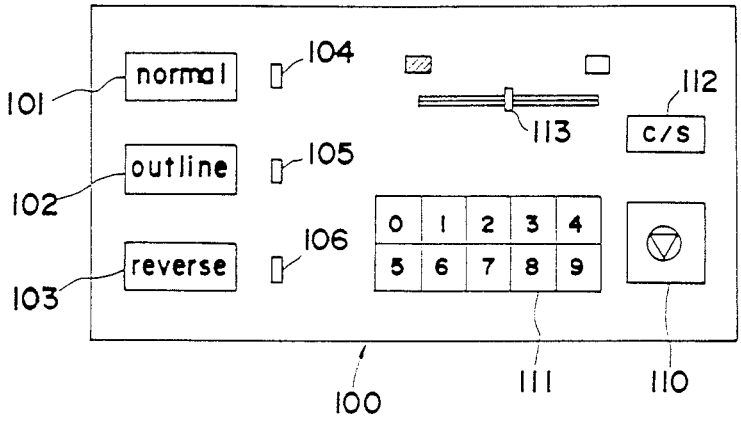

In FIG. 3, operation control panel 100 of the photocopier machine is shown only schematically. 101 represents a standard copy mode preselection key; 104 a display lamp thereof; 102 a peripheral outline image formation mode preselection key; 103 a reverse image formation mode preselection key; 106 a display lamp thereof; 110 a print key; 111 a ten key; 112 a clear/stop key; and 113 an image intensity adjusting key.

Figure 4:
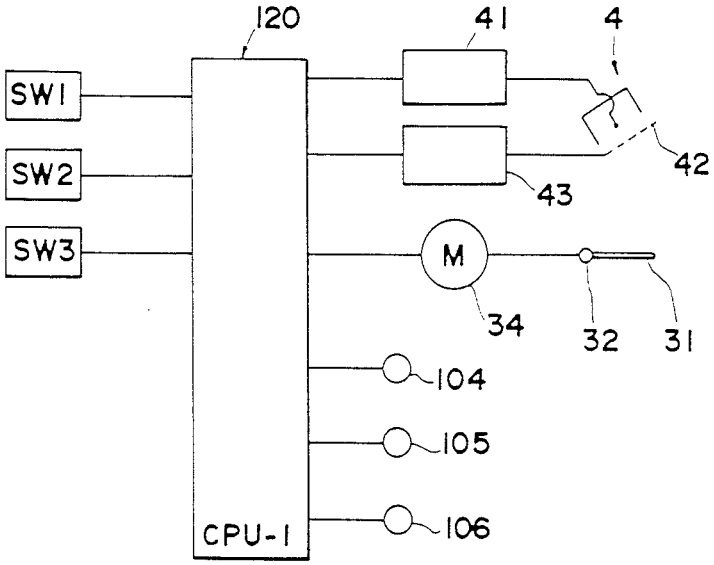

The control operation is executed through a microcomputer 120 acting as control center, as may be well supposed from FIG. 4, wherein 41 and 43 represent respective power source; 34 an electric motor adopted for control of on/off operation of screen 31.

Operation mode preselecting keys 101; 102 and 103 are controlled by on/off switches SW1; SW2 and SW3 by introducing on/off-control input signals into the microcomputer 120.

At this stage of description, chargers and the like operating constituents adopted in the present first embodiment will be described by showing their respective voltages and related polarities:

(I)

In case of use of non-magnetic and insulative toner charger (voltage source 21) - - - positive; +5.5 kV;
Scorotron charger (voltage source 41); - - - Negative; −6.0 kV;
Grid (voltage source 43) - - - Positive; +200 V;
Grid-photosensitive drum distance (dg) - - - 1.5 mm;
Developing bias (voltage source 53) - - - Positive; +300 V;
Transfer charger (voltage source 61) - - - Positive; +5.5 kV;
Non-magnetic insulative toner - - - Negative polarity; +5.5 kV;

(II)

In case of use of magnetic and insulative toner charger (voltage source 21) - - - Positive polarity; +5.5 kV;
scorotron charger (voltage source 41) - - - Negative polarity; −6.0 kV;
Grid (voltage source 43) - - - Positive polarity; +200 V;
Grid-drum distance (dg) - - - 1.5 mm;
Developing bias (voltage source 53) - - - positive porality (DC); +170 V; AC 350 V rms, 1 kHz;
Development initiation potential - - - +250 V;
Transfer charger (voltage source 61) - - - positive polarity; +5.5 kV;
Magnetic insulative toner - - - negative porlarity.

As a modification, if desired, all the porlarities set forth above may be reversed. It should be further noted that the voltage values set forth above have been shown only by way of example.

In the following, the image formation procedures with use of the foregoing copier machine will be illustrated in each of the operating mode and in the successive operating steps.

(Reverse image formation mode)

This operation mode can be executed by manipulation of preselection key 103 so as to make switch SW3 ON. At this moment, if the screen 31 is kept at receded, non-service position, motor 34 is brought into operation for advancing the screen into the exposure light passage. Naturally, power sources 41 and 43 are so controlled as to operate the scorotron charger 4. At the same time, display lamp 106 is ignited.

(i) First charging step

The drum surface 1 is impressed with a charge of a predetermined potential level under the operation of the charger 2. As the result, surface potential of the drum 1 is kept at +600 V in this first embodiment.

(ii) Exposure step

Under operation of screen 31, positive document images are slit-exposured onto the drum surface pre-charged to +600 V for the formation of corresponding latent images and through the intermediary of said screen. In this case, however, if the positive document images are subjected to the exposure without intermediary of the screen 31, the charge at the corresponding image area A will remain at the potential level of +600 V as shown only schematically at FIG. 7 (*a*).

In FIG. 7, while the potential at those corresponding to the non-image area or areas will be reduced to +100 V or so. Since the screen 31 is formed with a pattern consisting of a number of parallel lines or net dots of black or the like dark or thick color which can not pass lights therethrough, and thus, when the exposure operation is carried out through the intermediary of such patterned screen and with use of a white or blank document, a correspondingly finely patterned potentials will be resulted to appear, as shown at (b) in FIG. 7. Therefore, when a positively imaged document is subjected to expose through the intermediary of such patterned screen 31, the resulted electrical charge at those parts corresponding to the documentary image or images is not affected in any way by the screen pattern and remain the level of +600 V as before, as schematically shown at (c) in FIG. 7. On the other hand, the charge at the non-image area or areas will keep those values corresponding to the patterned parts (C), as is only schematically shown therein. On the other hand, the charge at the transparent area or areas will be reduced to +100 V or so under the influence of the light exposure.

(iii) Second charging step

In this step, the drum surface already formed thereon with latent images is subjected to the second charging operation or a recharging step in other words under the action of scorotron charger 4 by application of an electric charge of the polarity opposite to that which is prevailing at the static latent image areas. In this operation, grid 42 is impressed from voltage source 43 with a voltage of +200 V as an example. The voltage applied to scorotron charger 4 is of opposite polarity to that which has been adopted in the first charging step. The impressed voltage upon grid 42 is sufficiently lower than the surface potential, +600 V, residing at the latent image area or areas A as well as the pattern-corresponding portions C, and is of the same polarity with that which was adopted in the foregoing first charging step. It is to be noted that the voltage impressed upon grid 42 is higher than the surface potential, +100 V, residing at light-pass portions of the non-image areas comprised in the latent images, if any.

Figure 6:
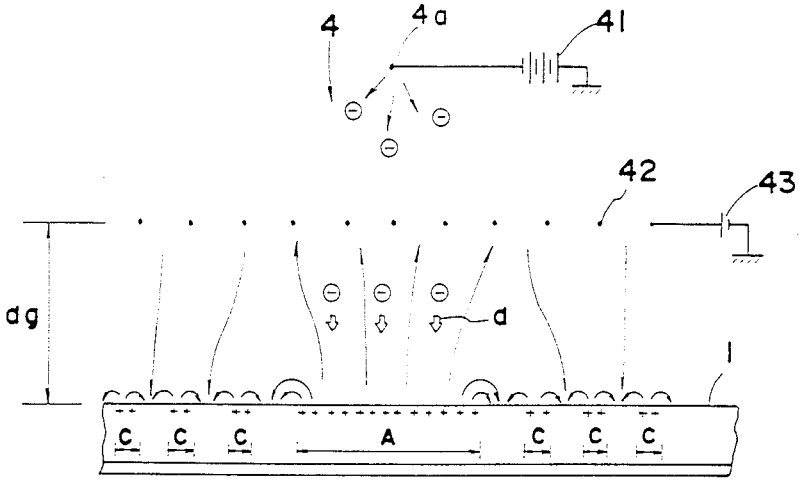
Figure 7A:
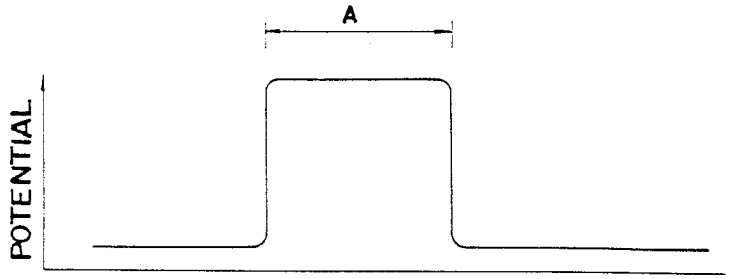
Figure 7B:
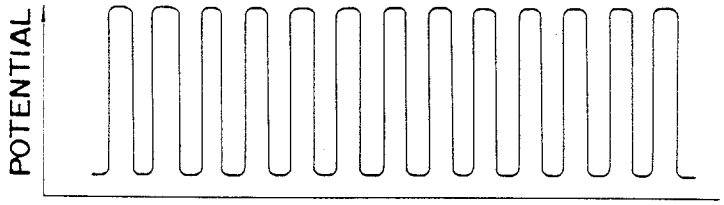
Figure 7C:
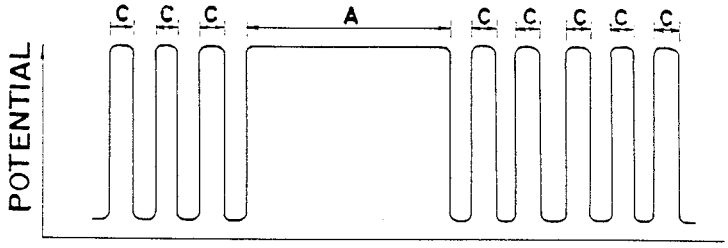
Figure 7D:
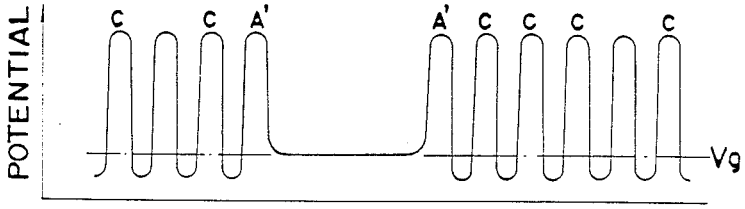
Figure 7E:
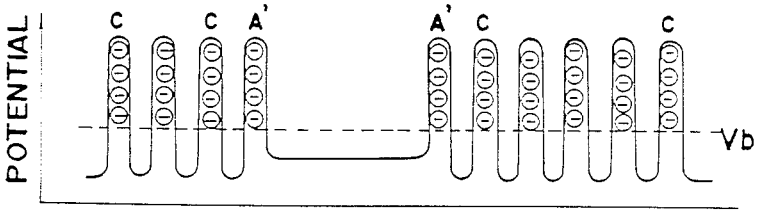

Between drum surface 1 and grid 42, electric lines of force will appear, as schematically shown in FIG. 6 by a number of small arrows. As a result, negative ions dissipated from the energized charge wire 4*a* will be subjected to drive or carrying force in the direction of these electric lines of forces. As seen, in this case, the electric lines of force driving the negative ions dissipated in proximity of grid 42 and therefrom, towards the drum surface are exclusively related with substantial and effective portion of the image area(s), thus excluding the outline margin thereof and all the non-image areas.

Therefore, the negative ions schematically and representatively shown by double-lined arrows d will impinge against the said substantial and effective portion of the image area(s), thereby removing the residual charges residing therein and lowering positively the voltage thereat to such a level as substantially equal to grid voltage Vg. More specifically, the surface potential at the substantial area of image portion A will be decreased to +200 V or so under such operating condition as with −6.0 kV of scorotron charger voltage at 41 and with +200 V of grid voltage at 43, respectively.

In other words, it results, in the present second charging step, in the formation of a pseudo-reversed negative latent image(s) derived from a corresponding positive documentary image(s), wherein however, the non-image area represents a finely distributed potential pattern corresponding to that of screen 31 and substantial part of the imaged area A is removed of charges.

(iv) Developing step

The latent images formed in the foregoing second charging step and in the pseudo-reversed negative image are then subjected to development under the action of developing unit 5. In case of the insulative toner being of non-magnetic, developing sleeve 51 is impressed with a developing bias of +300 V, which is selected to be somewhat higher than the potential +200 V residing at substantial part of imaged area(s) A and of same polarity to that which was employed in the first charging step for avoiding otherwise frequently invited "fogging" phenomenon caused by superfluous deposit of toner onto said area(s) as well as at the non-image and light pass portion of background area(s), where the surface potential has been subjected to reduction in the level during the second charging step.

On the other hand, in case of the insulative toner being magnetic, the developing sleeve 51 is impressed with AC-350 V and DC-plus 170 V in combination as the developing bias Vb. This bias voltage Vb is somewhat lower than surface potential +200 V held at substantial part of imaged area(s) A which has been lowered to grid voltage Vg or so. However, when the insulative toner used is magnetic, the developing operation will be initiated at a surface potential of +250 V or so, and indeed, by virtue of the very presence of a certain thereshold value under the influence of the magnetic binding forces. Thanks to the adoption of this effective counter measure, superfluous and fogging deposit of toner at the substantial part of the latent image area of areas A subjected to potential reduction in the foregoing second charging step can be effectively prevented from occurrence.

As seen clearly from the foregoing, a tonered image of the "preseudo-reversed" mode so to speak if formed effectively, and indeed, by reliance of the regular depositing technique and with use of negatively charged insulative toner which is deposited onto the higher potential portions on the drum surface 1 or more specifically peripheral outline portion(s) A′ of the imaged area(s) A, as well as the pattern-corresponding portions C of the non-imaged portion(s).

The thus tonered image is then transferred onto the copy paper 10 through the way of positive discharge at transfer charger 6 and further will be subjected to deposition onto the corresponding copy image under the action of a fixing unit, not shown.

The reason why the grid voltage Vg has been set to a sufficiently lower value than the surface potential +600 V at the latent image area(s), is sufficiently to lower the surface potential at substantial area of the imaged portion in the second charging step and relative to the former surface potential value.

As for the copy image thus formed, the non-image area(s) does not represent a perfectly full black or the like color, but a finely divided pattern mode one, in correspondence to the screen pattern, as at 31'*a* or 31''*a* in FIG. 2*a* or 2*b*. However, with use of sufficiently dense pattern, the visual appearance will provide a background area having a sufficiently even condensation. With use of too much finer pattern distances, troubles may be had, as will be more specifically set forth in the following.

Figure 8:
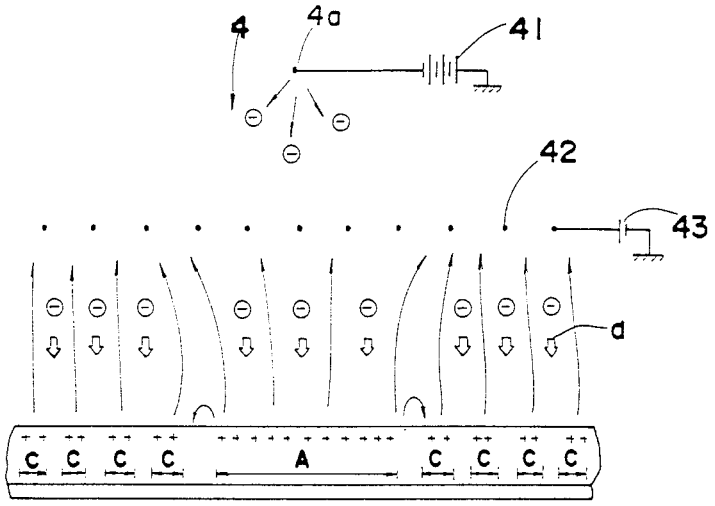

The first problem as encountered with too much finer pattern pitches among neighboring pattern-corresponding portions C in FIG. 8, electric lines of force appearing in the second charging step will represent mutually repulsing forces and can not, in practice, direct towards the drum surface 1, and instead, will direct towards the grid, thereby removal of charges being invited at the non-image area(s) disadvantageously.

Figure 9A:
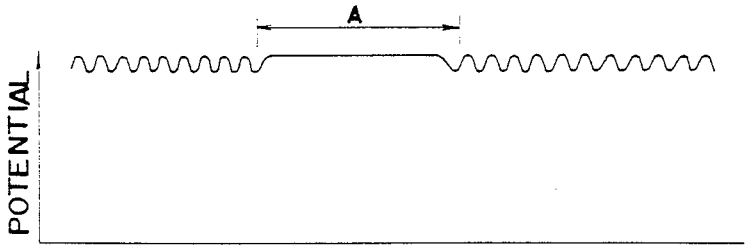
Figure 9B:
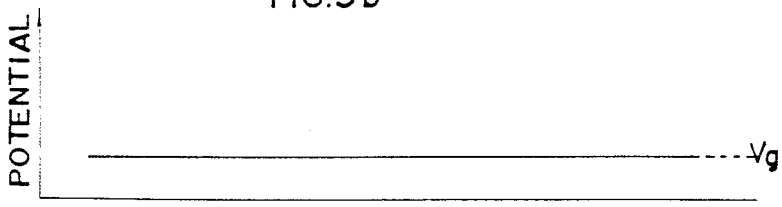
Figure 10:
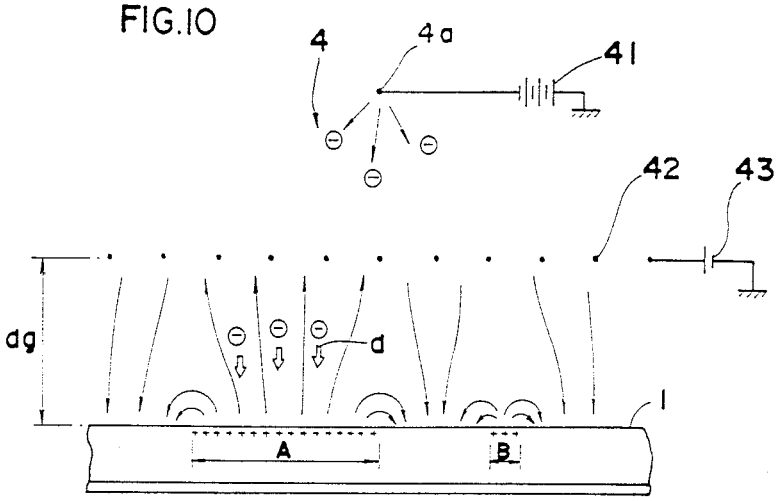

The second problem resides in such a difficulty in the formation of a sharp and clear patterned latent images on the photo-sensitive drum surface, with use of too much finely divided screen pattern, on account of occasionally introduced insufficient optical performance and mechanical vibration inherent in the exposure unit 3 as employed. As a result, such a disadvantageous phenomenon may occur that in the background area(s), electrical charges at the light-penetrated portions of the static latent images formed in the exposure step will not be subjected to substantially no reduction and may be substantially at the same potential level with that prevailing at the pattern-corresponding portions C, as is only schematically in FIG. 9 at (a). As a result as shown in FIG. 9 at (b), the charge removal may be brought into effect during the second charging step, not only at the latent image areas A, but also at the background areas.

According to our practical experiments, finest allowable pitches between pattern parallel lines 31'*a* or pattern dots 31''*a* in FIG. 2*a* or 2*b*, respectively, may preferably be 50 μm for providing better quality reverse images. On the other hand, upper limit of rough pitches may be set to 300 μm or so. It has been experimentally found that with use of wider pitches than the above specified upper limit, pattern images will be observed visually easily at the background area(s), resulting in invitation of inferior quality of the resulted images. Acceptable range of pattern line width and pattern dot diameter is from about 50 to about 300 μm for obtaining good quality of the reversed images.

Naturally, these above values are variable depending upon various setting and operating conditions and/or performances of the inventive copier machines and thus, it should be noted that they have been given only for the purpose of representative illustration and not limitative to the invention.

Peripheral outline image formation mode

This mode has its object to provide positive copy images exclusively of peripheral outlines positive document images, capable of being executed by making the switch SW2, FIG. 4, ON by manipulation of selection key 102, FIG. 3.

In this case, if the screen 31 is within the exposure light passage, it must be receded therefrom by actuation of the motor 34.

Necessary control of voltage sources 41; 43 so as to energize scorotron charger 4 must be executed for copy-making operation as in the same manner set forth in the foregoing reverse image formation mode. At the same time, display lamp 105, FIG. 3, is ignited.

(i) First charging step

Manipulation and operation are same with those adopted in the foregoing reverse image formation mode.

(ii) Exposure step

Figure 11A:
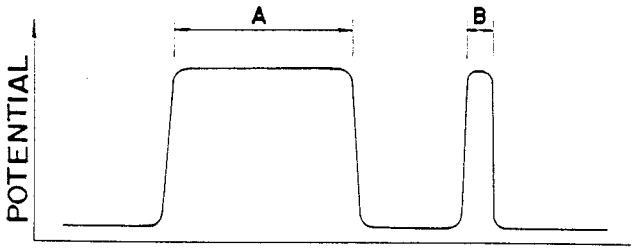
Figure 11B:
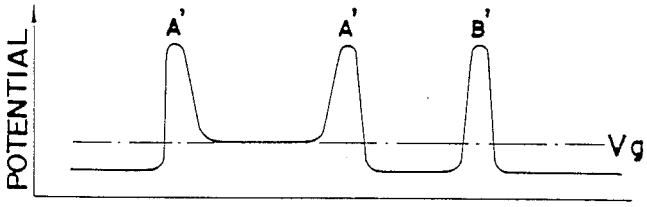
Figure 11C:
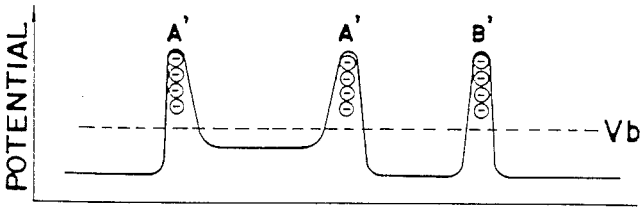

Positive document images are exposed in the slit exposure mode onto the drum surface 1 precharged at a potential level of +600 V without intermediary of screen 31 for formation of corresponding static latent images. In this case, as shown in FIG. 11 at (a), the potential charge at image areas A and B remains at the level of +600 V, while the charge at the non-image areas is subjected to reduction by the light projection to +100 V or so.

(iii) Second charging step

The drum surface 1 formed with the positive static latent images is subjected to recharging by means of scorotron charger 4.

Operating conditions of scorotron charger 4 in this operational step are same as those adopted in the foregoing reverse image formation mode already set forth hereinbefore. However, it should be noted that the formed appearance of the provided static latent images are different from the foregoing. More specifically, electric lines of force, shown equally in FIG. 10 by arrow-headed elongated schematic lines are formed, and negative ions dissipated from the energized charge wire are subjected to driving action along these electric lines of force as before. In this case, electric lines of force which are effective in proximity of the grid 42 to drive negative ions towards the drum surface 1, are generated at substantial part of imaged area A, however, devoid of the peripheral edge thereof. Therefore, these negative ions impinge exclusively upon said substantial image part, as shown by double-lined short arrows d, for removing the residing static charge thereat to such a degree that the related surface potential being lowered to such a level which is substantially equal to that of the grid voltage Vg.

More specifically describing in terms of drum surface potential, and referring to FIG. 11 at (b), the peripheral outline portion A' of image area A and a linear image portion B' are holding the initial surface potential level substantially equal to +600 V and at a substantially constant width, while the surface potential of the non-image areas is kept at a lower level substantially equal to +100 V, the potential level at substantial area of areal image portion A being lowered to such a level substantially equal to the grid voltage Vg. As for linear image portion B', it should be mentioned that the surface potential thereat represents no reduction in this case, yet the width of the charged area showing a reduction in size.

As may be well understood from the foregoing peripheral outlines of image areas A and B are formed in sum of corresponding positive latent images by the execution of the present second charging step.

(iv) Developing step

The positive peripheral outline latent images in the foregoing second charging step are then developed by the developing unit 5.

The operating conditions in this step are same as in the reverse image forming step. Thus, negatively charged insulative toner is deposited at higher potential regions on the drum surface, or more specifically on the peripheral outline portions A' and B' through the way of regular developing mode, so to speak in the way of "hemming-from-inside", to provide corresponding tonered visible outline images.

Standard copy mode:

In this mode, regular copy-making is performed in one-to-one relationship with the document images.

For this purpose, selection key 101 is depressed for bringing switch SW1 ON.

When screen 31 is positioned within the exposure light passage, motor 34 is energized to rotate for receding the screen from position. At the same time, display lamp 104 ignites. In the copying operation, the sources 41 and 43 are so controlled not to energize the scorotron charger 4, this operation being different from the foregoing two operation modes.

(i) First charging step

Operations are same with those which were adopted in the foregoing two modes of operation.

(ii) Exposure step

Operations are same with those which were adopted in the foregoing twp modes of operation.

(iii) Second charging step

Sources 41 and 43 are kept OFF, and scorotron charges is also kept in off-service. Therefore, this step is dispensed with. Thus, the positive latent images formed in the exposure step are transferred as per se to the next following developing step.

(iv) Developing step

Operations are same as those adopted in the foregoing two operation modes. In the present step, negatively charged insulative toner is deposited on the image portions A and B shown in FIG. 11 at (a), and thus, regular tonered images in correspondence with document images in one-to-one relationship are provided through the way of normal development.

[III]

Further, use of non-magnetic insulative toner in the present first embodiment, however, under modified operating conditions of scorotron charger 4 in the second charging step will be set forth.

In this case, operating conditions in the following, specifically slected-out items have been modified:

Scorotron charger (source 41) - - - negative; −7.0 kV;
Grid (source 43) - - - positive; +300 V;
Grid-drum spacing (dg) - - - 1.0 mm;
Developing bias (source 53) - - - positive; +250 V;

Image forming operations are same as those which were adopted in the foregoing two operation modes [I] and [II].

However, it should be noted that in the present modified embodiment, the voltage at source 41 is selected to be rather higher and the gap distance between grid 42 and drum surface 1 is somewhat reduced, thereby the charge removal performance of scorotron charger 4 being rather accentuated and the potential at substantial part of image area A being subjected to further reduction to +230 V or so which is somewhat lower than grid voltage Vg. And, developing bias voltage Vb is preset to +250 V which is lower than grid voltage Vg, +300 V. However, the lowered surface potential is still lower than developing bias voltage Vb, thereby positively preventing otherwise liable toner deposits in form of fogs on substantial part of image area A.

Second Embodiment (refer to FIGS. 12–15)

Main difference between the first and second embodiments resides in such that in the latter, alternating voltage is applied from source 41*a* to scorotron charger 4 adapted for execution of second charging step.

Used polarities and voltages at several chargers in the present second embodiment are similar as those which were adopted in the first embodiment at (I) and (II). It should be noted, however, that the voltage at source 41*a* of scorotron charger 4 is set to AC±6.0 kV, in common and irrespective of the magnetic feature of the insulative toner.

The image-forming operation will be kept set forth hereinbelow and step wise in accordance with operational modes and steps.

(Reverse image-forming mode)

(i) First charging step

Sensitive drum surface 1 is precharged at a predetermined potential level under the action of the charger 2. In this second embodiment, the drum surface potential is set again to +600 V.

(ii) Exposure step

Positive documentary images are slit-exposured through the intermediary of screen 31 on the drum surface 1 which has been precharged at the potential level of +600 V, for providing corresponding static latent images which are similar to those which are shown and described with reference to FIG. 7 at (c) only schematically and representatively.

(iii) Second charging step

The drum surface 1 formed with static latent images in the above manner is subjected to a recharging step under the action of scorotron charger 4 impressed with alternating voltage from source 41*a*. At this stage, grid 42 is impressed with a voltage of +200 V from source 43, as in the same manner in the first embodiment at (I) and (II).

Figure 12:
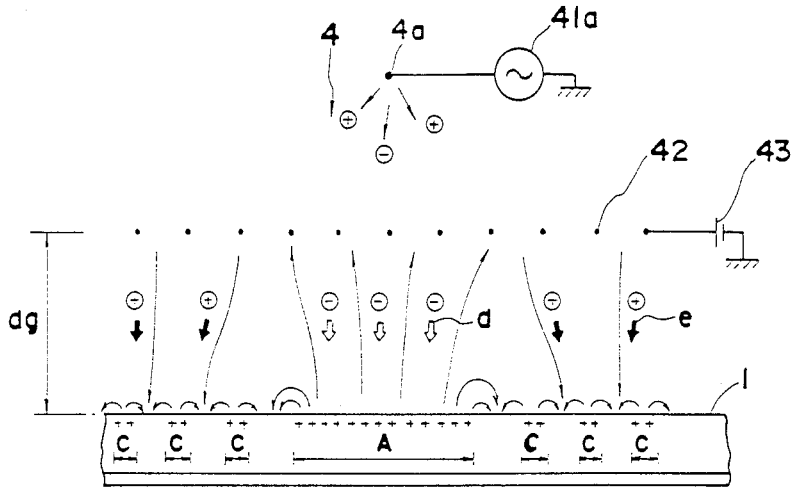
FIGS. 12-15 illustrate the second embodiment of the invention.

Between drum surface 1 and grid 42, electric lines of force, as shown in FIG. 12 by a plurality of elongated arrows as before. Negative and positive ions dissipated from the charge wire, similar with that denoted with 4*a* shown in FIG. 1, energized, however, in the present embodiment by application of alternating voltage from source 41*a*, FIG. 12, are subjected to carrying forces along the electric lines of force. It should be noted, however, that those electric lines of force which accelerate the negative ions in proximity of grid 42 towards the drum surface 1 are generated exclusively in relation with substantial part of the image area A, as in the similar manner already described in the foregoing first embodiment. Thus, these negative ions will impinge upon said substantial image area, as hinted in FIG. 12 by a plurality of small double-lined arrows d, thus the residing charges thereat being subjected to charge removing action and lowering to such a potential level nearly equal to the grid voltage Vg. On the other hand, the positive ions impinges upon the light-projected portions of non-image areas, as hinted by a plurality of short double-lined arrows e shown in FIG. 12, thereby the charges residing thereat being elevated to such a level as substantially equal to the grid voltage Vg.

Figure 13A:
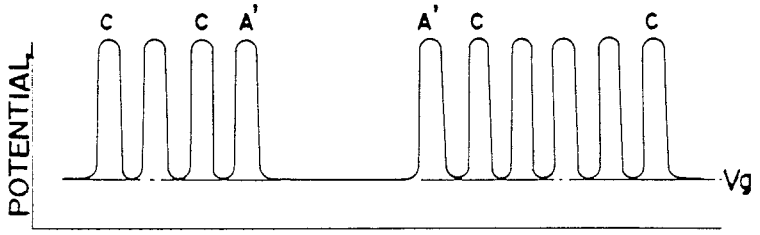
Figure 13B:
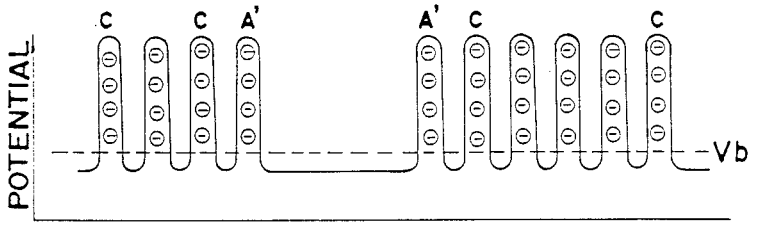

More specifically described in terms of drum surface potentials, as only schematically shown in FIG. 13 at (a), the potentials at outline periphery A' of the imaged area A, as well as the pattern-responding portions C at non-image area(s), remain at a initial high level, substantially equal to +600 V, each having substantially a constant width as shown, while the surface potential at the substantial part of imaged area(s) A is lowered substantially to grid voltage level Vg. More specifically, the surface potential at substantial part of image area(s) A and that prevailing at the light-impinged portions of non-image area(s), are lowered and elevated, respectively to +200 V or so, by application of ±6.0 kV to scorotron charger source 41*a* and of +200 V to grid voltage source 43, respectively.

In other words, also in the present second embodiment, and upon execution of the second charging step, a negative static latent images in form of a pseudo-reversed mode images of the positive documentary images can be effectively formed, wherein the non-image portions represent finely divided potential patterns in correspondence to the screen pattern, for instance at 31'*a* or 31''*a* shown in FIG. 2*a* or 2*b*, specific design of screen 31 in FIG. 1, as an example, and the potentials at substantial part of imaged area(s) A has been considerably removed of charge.

(iv) Developing step

The static latent images provided in form of said pseudoreversed, negative images in the foregoing second charging step are now subjected to development under the action of developing unit 5.

The developing conditions as well as operating mechanism hereinemployed are similar to those set forth before at (I) and (II) of the first embodiment. In the present second embodiment, even when the surface potential at the light-impinged areas of non-image portions of the latent images is caused to elevate considerably towards the grid voltage Vg or so, no deposits of toner thereto can be positively and effectively prevented, as in the case of substantial part of the imaged areas as at A. Thus, excess deposit of fouling or fogging toner can be avoided.

(Peripheral outline image formation mode)

(i) First charging step

Operations are similar to those employed in the foregoing reverse image formation mode.

(ii) Exposure step

Figure 15A:
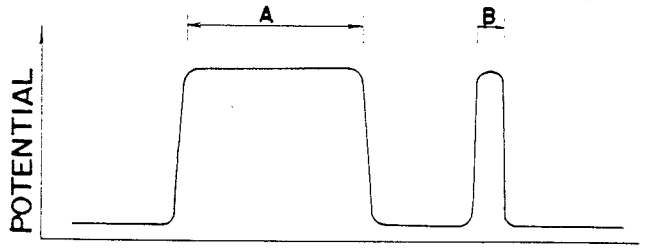
Figure 15B:
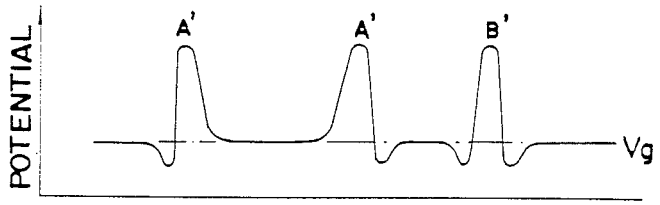
Figure 15C:
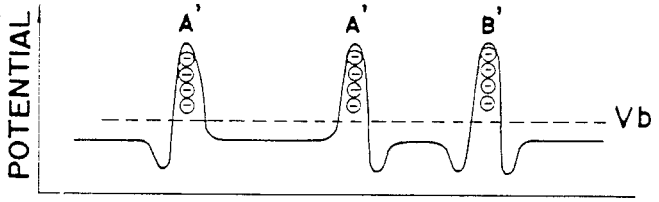

Without use of screen 31, positive documentary images are slit-exposed for the formation of corresponding positive latent images (refer to FIG. 15 at (a)).

(iii) Second charging step

The drum surface 1 formed with positive latent images is subjected to a recharging step under the action of scorotron charger 4 impressed with an alternating voltage from source 41*a*.

Operating conditions of scorotron charger 4 as adopted in the present operation step are similar to those adopted in the reverse image formation mode. However, the appearance and structure of the thus formed latent images are different from the foregoing.

Figure 14:
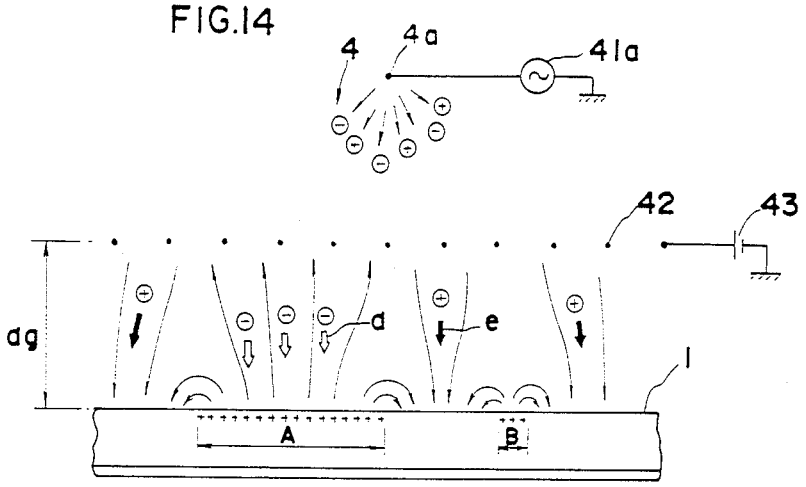

More specifically, electric lines of force, shown as before, representatively with elongated arrows in FIG. 14 are formed between drum surface 1 and grid 42. Negative and positive ions dissipated from the charge wire 4*a*, FIG. 14, energized with an alternating voltage from source 41*a* are subjected to driving forces along the electric lines of force. In this case, such electric lines of force as driving the negative ions in proximity of grid 42 towards the drum surface exist exclusively above the substantial part of imaged area(s) A in FIG. 14, and as similar to the foregoing case shown in FIG. 12. Therefore, the negative ions will impinge upon the said substantial part, as hinted by short double-lined arrows, for considerable removal of static charges prevailing thereat, thereby the static potential underconsideration being lowered to such a level substantially equal to the grid voltage Vg. On the other hand, the positive ions impinge upon the non-image areas, devoid of outside zones of peripheral outlines A'; B' of imaged areas A; B, as being schematically hinted by thickened short arrows e shown in FIG. 14, thereby elevating the surface potentials at the ion-impinged areas, to such a level substantially equal to the grid voltage Vg.

When further describing in terms of drum surface potentials and more specifically, referring to FIG. 15 at (b), potentials at the peripheral outlines A'; B' of imaged areas A; B are left substantially at the level of +600 V, having a constant width, which corresponds to the initial surface potential level, while outside slender zones of said peripheral outlines A'; B' and consisting of a part of the non-image areas are left at a low potential level substantially equal to 100 V. Further, potentials at the background areas devoid of said outside slender zones of peripheral outlines A'; B' are elevated substantially to the potential level of grid voltage Vg, while the potentials residing at substantial part of imaged area(s) A will be lowered substantially to the level of grid voltage Vg or so.

As a result of the foregoing nature and function of the present second charging step, the marginal outlines of imaged areas A; B will be formed in the form of positive static latent images.

(iv) Developing step

Operations are similar with those which have been described hereinbefore with reference to the reverse image formation mode. Negatively charged insulative toner deposits on the high potential portions of drum surface 1, or more specifically onto the peripheral outlines A'; B'. In this way, the tonered images thereof are formed in the "from-inside-hemming mode" so to speak, and through the way of normal developing operation.

(Standard copy mode)

Operations are substantially same as in the foregoing first embodiment.

The screen 31 is receded from position within the exposure light passage and scorotron charger 4 is kept at off-service.

Third Embodiment of the Invention

In the following, the third embodiment will be illustrated. However, the copying machine to be used in the present embodiment is of substantially similar structure in the case of first embodiment so that different points therefrom may be stressingly set forth hereinafter. Constituent parts illustrated with reference to FIG. 1, same reference numerals, will be used as before, however, preferably by attachment of a dash or "A" in each case.

Figure 16:
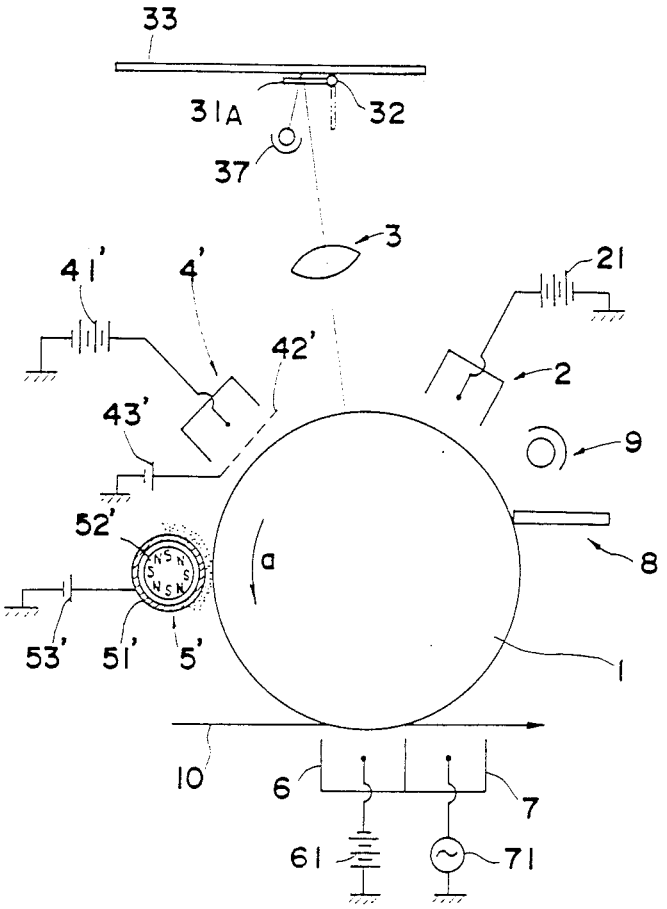
FIGS. 16-24 illustrate the third embodiment of the invention.
Figure 17A:
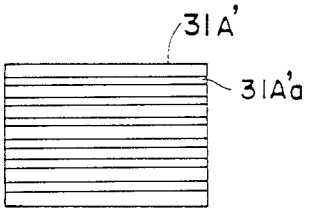
FIGS. 17*a* and 17*a* represent schematic plan view of two different modes of the screen member shown in FIG. 16.
Figure 17B:
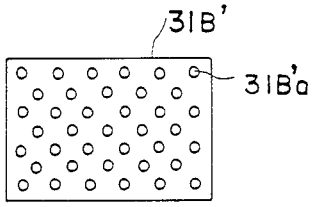
Figure 18:
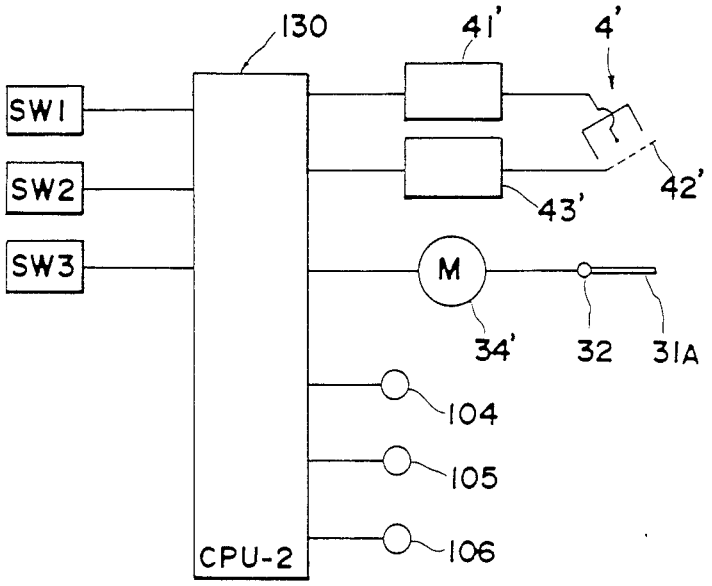

In the photo-copier machine schematically shown in FIG. 16, numeral 31A represents generally a screen member which is embodied in practice, however, as such shown in FIGS. 17*a* and 17*b*, at 31A' and 31B', respectively.

The foregoing screen 31 shown in FIG. 1 represents a set of fine parallel color stripes 31'*a* extending traversely of the document image scanning direction, while in the present embodiment, the parallel stripes 31A'*a* extends traversely in the similar manner, however, the parallel stripes consisting white or bright color material, adapted for well-reflecting the impinge light. The substrate material may be substantially same as before. The modified screen 31B' shown in FIG. 17*b* comprises a net dots 31B'*a*, each of which consists of white or bright color material adapted for well-reflecting coming light or lights.

However, the pattern direction of fine parallel stripes may be preselected so as to make coincidence with the document image scanning direction. In the last-mentioned case, the two different counter measures either of which acts against occasional occurrence of inferior quality of formed images by the screen, as was referred to hereinbefore with reference to FIG. 1, could also be employed.

In the following, the present embodiment will be illustrated with the screen positioned with its pattern directing traversely relative to the documentary image, scanning direction.

Scorotron charger 4' serves for execution of the second charging step on the drum surface 1 previously formed by the exposure unit 3 with static latent images as before. The charge wire 4*a*' is connected with a voltage source 41', while grid 42' is connected with another voltage source 43'. The d.c.-voltage supplied from the source 41' to charge wire 4*a*' has same polarity with that applied to said charger 2. Grid 42' is impressed from source 43' with a voltage having a sufficiently higher potential level than the surface potential at the static latent image portions and in same polarity with the voltage at the charger 2. It is necessary to set the voltage applied to grid 42' to a lower than the high level potential at the static latent image areas.

Developing unit 5' is provided with a developing sleeve 51' which includes in its inside space a magnet roller 52' having at its periphery a plurality of alternatingly arranged N- and S-pole segments and operates in the known magnetic brushing system. The developing sleeve 51' is also capable of acting as an developing electrode, and is connected with a developing bias voltage source 53'.

The developing agent consists of a mixture of a magnetic carrier material with insulative toner, these constituents being charged at opposite polarities to each other by reliance of conventional friction charge technique. The insulative toner is charged at same polarity with that of the potential at the charger 2.

When the insulative toner is non-magnetic, the developing sleeve 51' is impressed from source 53' with a developing bias voltage at somewhat lower potential than the surface potential at the latent image areas, which has been subjected to a potential increasing by the foregoing execution of second charging step, said bias voltage having same polarity with the charger 2. The insulative toner may be magnetic, if desired. It is also possible if desired to set the bias voltage so as to have a somewhat higher voltage level than the surface potential at the latent image areas, which has been subjected to a potential rise during the foregoing second charging step. It is also possible to use such an overlapped bias voltage with an alternating voltage. If the toner is magnetic, the insulative toner may be used as per se.

The operation panel to be used in the present embodiment may be same as that which has been shown and illustrated with reference to FIG. 2. Therefore, detailed description may be dispensed with for understanding of the invention.

Operation control procedures are executed through a microcomputer 130 acting as a control center. On/off control of voltage sources 41'; 43', motor 34' for advancing and receding the screen 31A and the like, is executed. By manipulation of mode-selection keys 101; 102 and 103, the corresponding on/off signals are generated and conveyed to the computer 130.

Polarities and voltages at several chargers and the like constituents will be set forth hereinunder.

(IV)

In case of the use of non-magnetic insulative toner charger (source 21) . . . positive; +5.5 kV;
Scorotron charger (source 41') . . . positive; +6.0 kV;
Grid (source 43') . . . positive; +500 V;
Grid-photosensitive drum distance (dg) . . . 1.5 mm;
Developing bias (source 53') . . . positive; +400 V;
Transfer charger (source 61) . . . negative; −5.5 kV;
Non-magnetic insulative toner . . . positive;

(v)

Use of magnetic insulative toner charger (source 21) . . . positive; +5.5 kV;
Scorotron charger (source 41') . . . positive; +6.0 kV;
Grid (source 43') . . . positive; +500 V;
Grid-drum surace distance (dg) . . . 1.5 mm;
Developing bias (source 53') . . . positive (DC); +530 V;
Developemnt start potential . . . +450 V;
Transfer charger (source 61) . . . negative; −5.5 kV;
Magnetic insulative toner . . . positive.

All the foregoing polarities may be reversed if wanted. The above voltages are only for illustrative and thus not limitative. Image formation modes and the like will be set forth in individual operation modes and stepwise. (Reverse image formation mode)

This operation mode is brought into effect by manipulation of mode selection key 103 for making switch SW3 ON. In this case, if screen 31' is at its receded position, then the motor 34' is energized to rotate, so as to advance the screen into the exposure light passage. Further, in the copying operation step, scorotron charger 4' is actuated by proper control of voltage sources 41'; 43'. At the same time, display lamp 106 is ignited.

(i) First charging step

A predetermined potential charge is applied onto the photosensitive drum surface 1 by energization of charger 2. As a result, the drum surface potential is kept at +600 V in the present embodiment.

(ii) Exposure step

Negative document images are subjected to slit exposure through the intermediary of the screen 31A onto the drum surface 1 precharged to +600 V in the above mentioned way so as to form corresponding static latent images. In this case, when the negative documentary images are exposed through the screen 31A, the electric charge corresponding to imaged area A is lowered to +100 V or so by the light exposure, while the charge corresponding to the non-image area will remain at +600 V-potential, as being illustrated in FIG. 20 at (a). Since the screen 31A represents a pattern as comprising white or bright color fine parallel lines or fine net dots provided on a transparent substrate board, and thus, when a black document is exposed through the screen 31A, a pattern consisting of a large number of finely divided and fine-pitched, potentialized lines or dots will be formed, as shown in FIG. 20 at (c).

Thus, when a negative documentary image is exposed through the screen 31A, as seen from FIG. 20 at (c), the electric charge at the place corresponding to the imaged area A is not affected by the screen pattern and will be reduced to +100 V or so under the influence of the light projection, while, in the non-image area, the potentials at the portions C corresponding to the screen pattern will be reduced to +100 V or so under the influence of light projection and the charges at transparent and light-pass allowing substrate portions remain as per se at the level of +600 V.

(iii) Second charging step

The drum surface formed iwth static latent images is subjected to a recharging operation by applying a charge having same polarity with that of the latent images under the action of scorotron charger 4'. At this stage, a voltage amounting +500 V is applied to grid 42' from voltage source 43'. The voltage impressed upon scorotron charger 4' is of same polarity was adopted in the foregoing first charging step. On the other hand, the voltage which is impressed upon grid 42' is sufficiently higher than the surface potential (+100 V) residing at latent image area A and pattern-corresponding portions C and is of same polarity as that adopted in the first charging step. Further, the voltage applied to grid 42' is lower than the surface potential (+600 V) at light-pass-allowing portions of the non-image area of the latent image.

Figure 19:
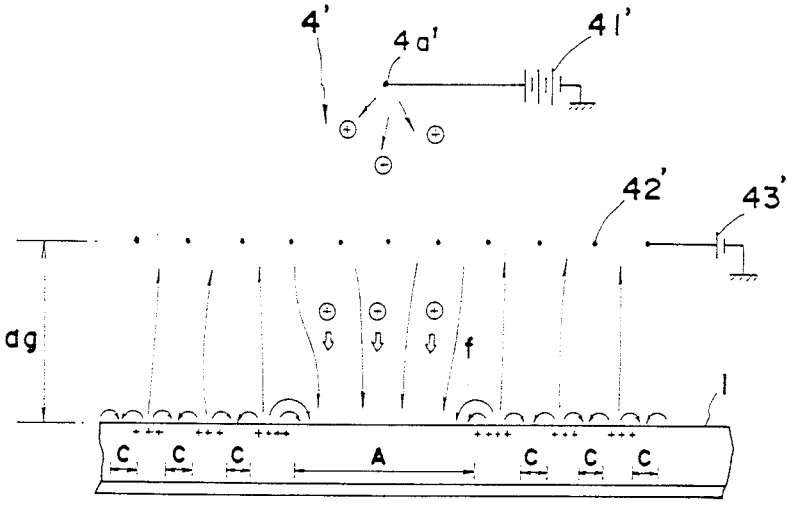
Figure 20A:
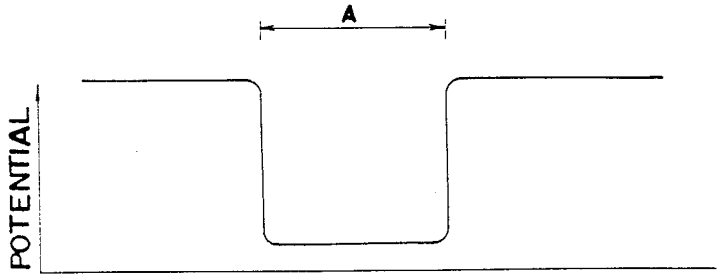
Figure 20B:
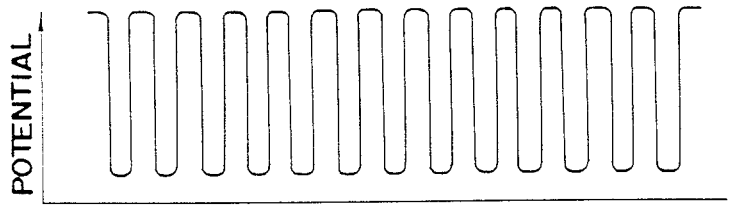
Figure 20C:
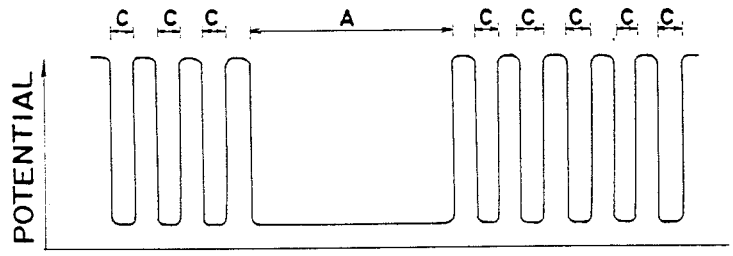
Figure 20D:
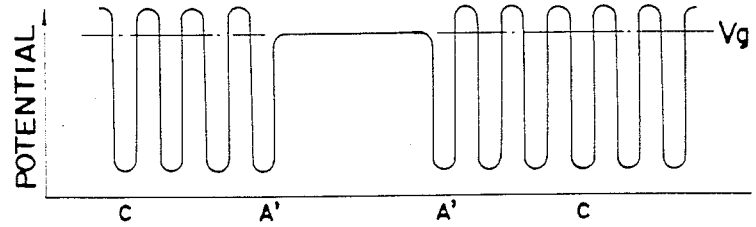
Figure 20E:
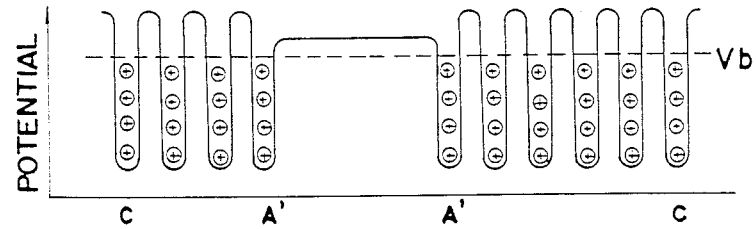

Between drum surface 1 and grid 42', a plurality of electric lines of force are generated, as shown elongated arrows in FIG. 19, thereby the positive ions dissipating from the charge wire are subjected to carrying forces acting along these electric lines of force. In this case, the lines of force acting to drive these negative ions in proximity of grid 42' towards the drum surface are those generated exclusively in the range as defined by substantial and effective area of the imaged portion, and indeed, devoid of the peripheral outline portions of the latent image. Thus the positive ions impinge exclusively upon substantial and effective portion of imaged area A as schematically shown by small double-lined arrows f in FIG. 19, thereby the surface potential at the ion-impinged area being elevated substantially grid voltage Vg or so.

When describing more specifically, the above operations in terms of surface potentials at the drum surface with reference to FIG. 20 at (d), the potentials at peripheral outline portion A' and screen pattern-corresponding portions C in the range of non-image areas remain at a low potential level of sbustantially at +100 V or so, while the surface potential at light pass-allowing portions of non-image areas will remain at a high potential level of substantially +600 V and the surface potential at substantial and effective portion of imaged area A will rise up nearly to grid voltage Vg. Or still more specifically, the surface potential at substantial portion of image area A will rise up nearly to +500 V by voltage application of +6.0 kV to scorotron charger's voltage source 41' as well as by application of +500 V to grid voltage source 43'.

In other words, upon execution of present second charging step, a positive latent image which has been pseudo-reversed from a negative documentary image, wherein, however, the non-image portion comprises a pattern of a large number of finely devided and fine-pitched charge elements corresponding to the pattern of screen 31A, while substantial and effective portion of the image area A has been statically charged.

(iv) Developing step

The static latent image formed in the foregoing second charging step and in the form of pseudo-positive image is then subjected to deposition at the developing unit 5'. When the insulative toner is non-magnetic, developing sleeve 51' is impressed with a developing bias of +400 V. This developing bias voltage Vb is set to be somewhat lower than surface potential (+500 V) at substantial portion of image area A and to represent same polarity with that which was used in the foregoing first charging step, for positively preventing the toner from fouling and fogging deposits thereof to substantial part of the image area A where the surface potential has been elevated considerably in the second charging step, as well as the light-pass allowing portions of the non-image areas.

On the other hand, when the insulative toner is magnetic, a developing bias of AC 350 V, 1 kHz, and DC +530 V is applied to the developing sleeve 51'. It will be noted that this developing bias voltage Vb is somewhat lower than the potential at substantial part of image area A which has risen to such a level as substantially equal to grid voltage Vg. However, with use of magnetic insulative toner, there is a certain threshold value by virtue of the very existence of magnetic binding force, and the development will be initiated substantially at +450 V of the surface potential. For this reason, otherwise possible fouling and fogging deposits of toner at substantial part of static latent image area(s) A where the surface potential has elevated to a considerable degree during the second charging step, as well as light pass-allowed portions of the non-image area(s), can be positively prevented.

It should be noted therefore that the positively charged insulative toner deposits at low potential parts of the drum surface or more specifically peripheral outlines A' of image portions A and pattern-corresponding portions C, thereby pseudo-reversed tonered images are formed through the reverse development technology.

These tonered images are then transferred onto the copy paper 10 by negative discharge at the transfer charger 6, the thus imaged-transferred copy paper will be conveyed through a conventional fixing unit, not shown, to provide a copy image-carrying paper.

The foregoing measure to set and keep the grid voltage Vg at a sufficiently higher level than the surface potential (+100 V) at the latent image area(s) is for such purpose as to allow in the second charging step the surface potential at substantial part of the imaged area(s) to sufficiently rise up relative to the former surface potential level.

As for the final copy images, the non-image area does not become represent full-dark, but shows a slight condensation of finely divided and fine-pitched color stripes or dots, in correspondence with the pattern on screen 31A. However, by proper selection of the fineness of size and pitch, the viewer can well recognize an evenly concentrated appearance of the background by adjudging his visual eyes. However, when employing too much rough pitches, the following problems may liably be invited.

Figure 21:
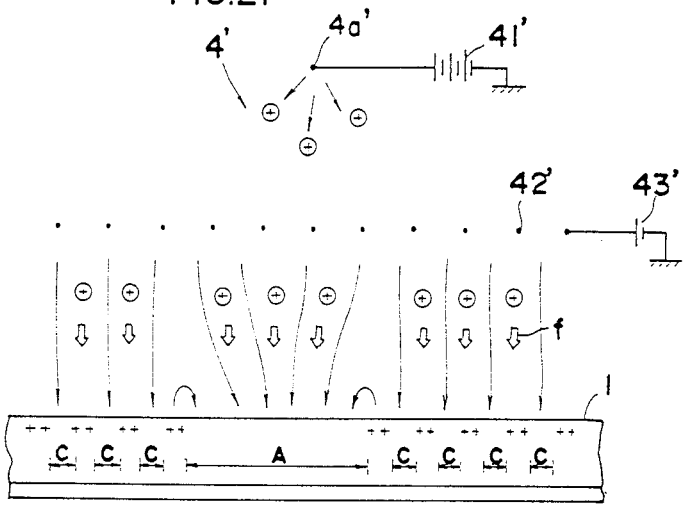

The first problem resides in such that if neighboring pattern elements C are positioned too much closely, mutual repulsing phenomenon will be brought about and electric lines of force could direct in the second charging step towards the drum surface, and instead, directing towards the grid, thereby the background portions being disadvantageously charged, as will be clearly seen from FIG. 21.

The second problem resides in such a fact that with use of too much finer mutual distances between and among patter-constituting elements in form of parallel stripes or net dots and when the exposure unit 3 represents inferior optical performance or it is subjected to mechanical vibration, a considerable difficulty will be encountered in the formation of finely divided and/or fine pitched elementl pattern images on the drum surface. In this case, it is noted that static latent images formed in the exposure step represent such a feature as shown schematically in FIG. 22 at (a), no appreciable charges remain at light-pass portions in the non-image area, resulting in the residual charges thereat representing practically no potential reference in comparison with those appearing at screen pattern-corresponding portions C.

Figure 22A:
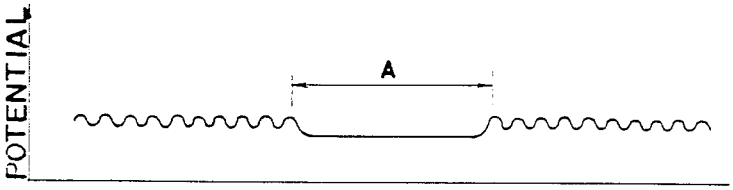
Figure 22B:
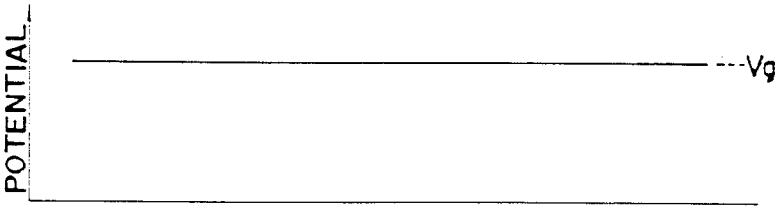

As the result, as seen from FIG. 22 at (b), the imaged area)s) A as well as the non-image portions will be statically charged upon execution of second charging step.

According to our practical experiments, finer limit may preferably be set to the pitch at 50 μm for obtaining better quality reversed image(s) between screen stripes or dots. The roughness limit in this respect may preferably be set to 300 μm. With coarser pitches than that limit, the pattern at the non-image area can be easily detected by human visual eyes; and indeed, together with correspondingly invited rather inferior quality of the images. In the similar way, line width and dot diameter may preferably be set to within the limit of 50–300 μm, for obtaining better and acceptable results.

It should be noted, however, the numerical values raised in the foregoing are given only for illustrating purpose and thus not limitative to the invention.

(Peripheral outline image formation mode)

This mode has its object to form positive copy image of peripheral outline from negative documentary image. This job can be executed by manipulation of selection key 102 to make switch SW2 ON. When the screen 31A is held in advanced position within exposure light passage, the screen must be receded from position by energization of motor 34'. In the copying operation, scorotron charger 4' must be operated by controlling sources 41' and 43', as in the case of said reverse image formation mode. At the same time, display lamp 105 is ignited.

(i) First charging step

Operations are same as in the foregoing reverse image formation mode.

(ii) Exposure step

Figure 24A:
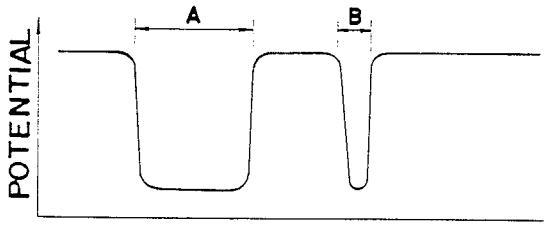
Figure 24B:
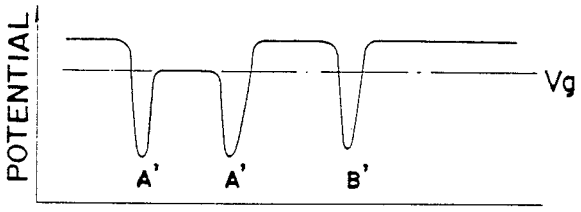
Figure 24C:
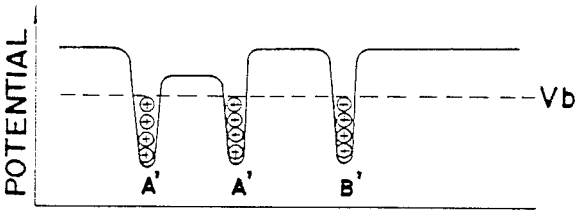

Negative documentary images are slit-exposured on the drum surface precharged at a potential of +600 V, for providing negative latent images. In this case, as shown in FIG. 24 at (a), the charges at imaged areas A and B are subjected to reduction to the lower level of +100 V or so by virtue of the executed light exposure step, while the static charges at non-imge areas remain at the high potential level of +600 V.

(iii) Second charging step

The photosensitive drum surface 1 formed with negative static latent images is then subjected to recharging under the action of scorotron charger 4'.

Figure 23:
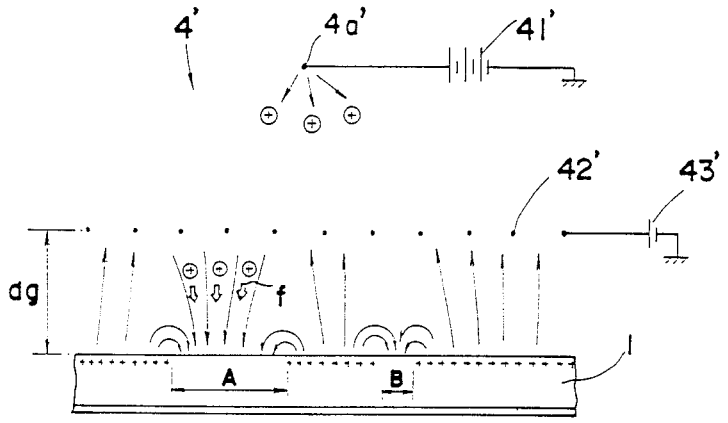

Operational conditions of this charger 4' are similar to those which have been adopted in the foregoing reverse image formation mode. However, the appearance of the formed static latent images are different from the foregoing. In this case, also, electric lines of force shown by elongated arrow headed lines in FIG. 23 are formed between drum surface 1 and grid 42'. Positive ions dissipated from the energized charge wire 4a' are subjected to drive forces along the electric lines of force, as before. In this case, however, those electric lines of force which urge the positive ions in proximity of grid 42' towards the drum surface, are generated with relation to substantial and effective part of the areal image portion A only, being, however devoid of the marginal peripheral outline. Therefore, the positive ions will, as shown by double-lined small arrows f in FIG. 23, impinge exclusively upon the said substantial and effective parts thereby executing a charging action thereat to elevate the potential level substantially to that of grid voltage Vg.

When further describing in terms of surface potential at the drum surface, those residing at the outline parts A' of areal impaged portion A, as well as at a linear imaged portion B' are left in substantially constant and width at a low potential level of substantially +100 V and those at non-image portions are left at a high potential level of substantially +600 V which is equal to the initial drum surface potential, while that of said substantial and effective part of the aerial imaged portion A is elevated to nearly to the grid voltage Vg. The surface potential at the linear image portion B' will not subjected to reduction, but the width is slightly reduced in comparison with those at the said peripheral outlines.

As a conclusion, the peripheral outlines of imaged portions A and B are represented in the form of negatively charged latent images.

(iv) Developing step

Static latent images formed in the form of negative images of peripheral outline portions are subjected to developing at the developer unit 5'.

Developing conditions adopted in the present step are similar to those which have been adopted in the foregoing reverse image formation mode. As a result, positively charged insulative toner is deposited onto lower potential parts on the drum 1 or in other more specific words peripheral outline parts A' and B' as an example, thereby tonered images being formed in the insidely embroiding manner, so to speak, through the way of the reverse developing mode.

(Standard copy mode)

For operational initiation of this mode, adapted for performing conventional negative-positive copy formation, wherein negative documentary images are converted into corresponding positive copied images, mode selection key 101 is manipulated to make switch SWI ON. If, at this moment the screen 31A is kept at advanced and service position within the exposure light passage, motor 34' is energized to recede the screen from position. At the same time, display lamp 104 is ignited. In this operation mode, sources 41' and 43' are so controlled that scorotron charger 4' is kept in off-service position, which control operation being thus different from the conditions which were adopted in the foregoing two operation modes.

(i) First charging step

Operations are similar to those adopted in the foregoing two operation modes.

(ii) Exposure step

Operations are similar to those adopted in the foregoing two operation modes (refer to FIG. 24 at (a)).

(iii) Second charging step

Voltage sources 41' and 43' and scorotron charger 4' are all kept at off. Thus, the present step is dispensed with. Therefore, negative latent images formed in the foregoing exposure step are transferred as per se to the next developing step.

(iv) Developing step

Operations are similar to those which were adopted in the foregoing two operation modes. Therefore, the positively charged insulative toner deposits on imaged areas A and B, thus regular tonered images corresponding to negative documentary images being formed through reverse image formation procedures.

(IV)

In case of use of non-magnetic insulative toner in the present embodiment, a modification of second charging step, wherein operating conditions of scorotron charger 4' have been somewhat changed. In this modification, the following items of the operating conditions set forth as (IV) using non-magnetic insulative toner have been modified.

Scorotron charger (source 41') . . . positive; +6.5 kV;
Grid (source 43') . . . positive; +400 V;
Grid-drum surface distance dg, . . . 1.0 mm;
Developing bias (source 53') . . . positive; +430 V.

Image forming operations to be adopted in the three different modes are similar as adopted at the foregoing (IV) and (V).

However, in the present modification, the voltage at the source 41' is selected higher and the drum-grid gap distance dg, is preset to a somewhat smaller than before, the charging performance of scorotron charger 4' is elevated so far, thereby the potential at substantial part of the image area A being elevated to nearly +450 V which is somewhat higher than grid voltage Vg. Although developing bias voltage Vb is set to +430 V which is higher than grid voltage Vg: +400 V, the formerly set forth elevated surface potential is nevertheless higher than the developing bias voltage Vb, thus superfluous and foggy attachment of the toner at substantial part of the imaged area A being positively avoided.

(Fourth embodiment (refer to FIGS. 25–28))

Difference of the present embodiment from the foregoing third embodiment resides in such that the scorotron charger 4' serving in the second charging step is impressed with an alternating voltage from source 41*a'*.

Polarities and voltages used for the several chargers are generally similar to those which were adopted at (IV) and (V) in the foregoing third embodiment. However, the voltage at source 41*a'* for scorotron charger 4' are set commonly to AC ±6.0 V, irrespective of magnetic or nonmagnetic property of the insulative toner to be used.

Next, the image forming process will be described modewise and stepwise as before.

(Reverse image formation mode)

(i) First charging step

A constant potential is applied onto photosensitive drum surface 1. Upon execution of present first charging step, the drum surface 1 is kept at a level of +600 V.

(ii) Exposure step

Negative documental images are slit-exposed through the intermediary of screen 31A onto the drum surface 1 precharged with +600 V in the above manner, for the formation of latent images corresponding to the documentary images.

A representative example of these latent images is shown only schematically and representatively and in its potential at (c) of FIG. 20.

(iii) Second charging step

The drum surface 1 is then subjected to a recharging step under the action of scorotron charger 4' impressed with an alternating voltage. In this case, grid 42' is impressed with a voltage of +500 V from source 43', in the similar manner as was referred to hereinbefore at (IV); (V) of the foregoing third embodiment.

Figure 25:
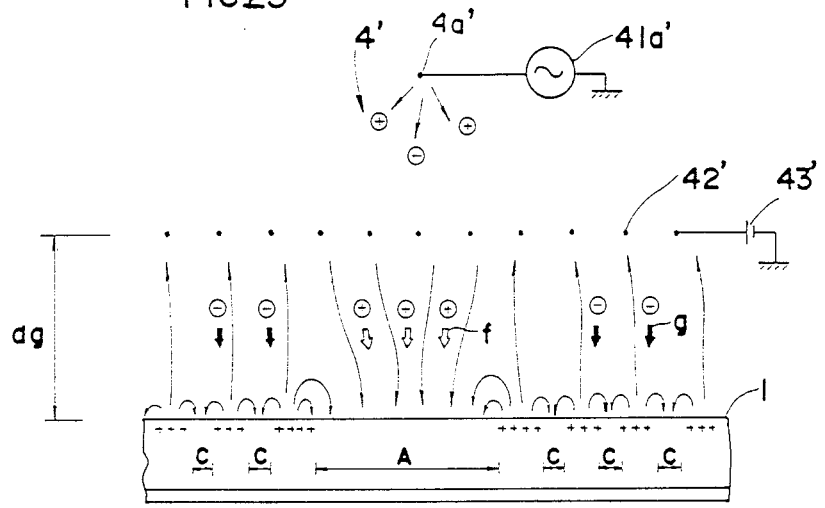
FIGS. 25-28 illustrate the fourth embodiment of the present invention.

Between drum surface 1 and grid 42', there are formed electric lines of force as schematically and representatively shown several elongated arrows as before in FIG. 25. Negative and positive ions dissipated from charge wire 4'*a* are subjected to carrying drive forces along these lines. In this case, the lines of force for driving positive ions in proximity of grid 42' towards the drum surface are generated in the range of substantial and effective part of the image area A only representatively shown, as in the similar manner already described in the foregoing third embodiment. Therefore, positive ions impinge upon exclusively said substantial image part, as shown by double-lined short arrows f in FIG. 25, thus additionally charging to and elevating the previous potential level to that which is substantially equal to grid voltage Vg. On the other hand, negative ions will impinge upon light-pass allowed parts of the non-image area(s), thereby the residing potential thereat being lowered nearly to the grid voltage Vg, as shown representatively by thick and short arrows g.

Figure 26A:
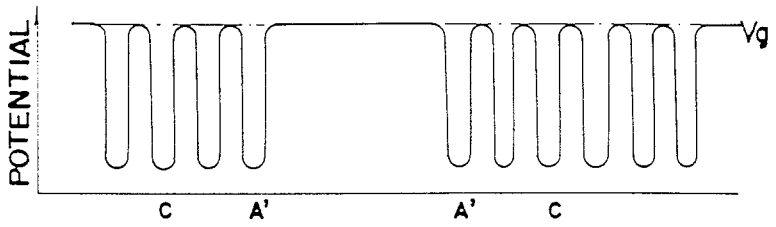
Figure 26B:
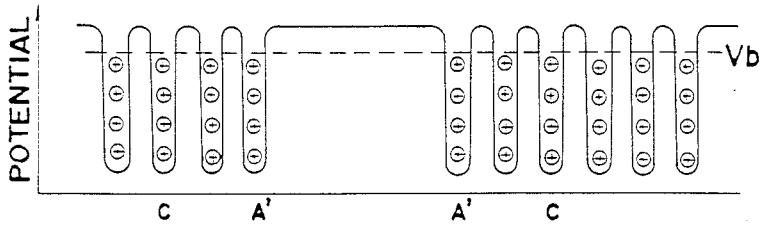
Figure 27:
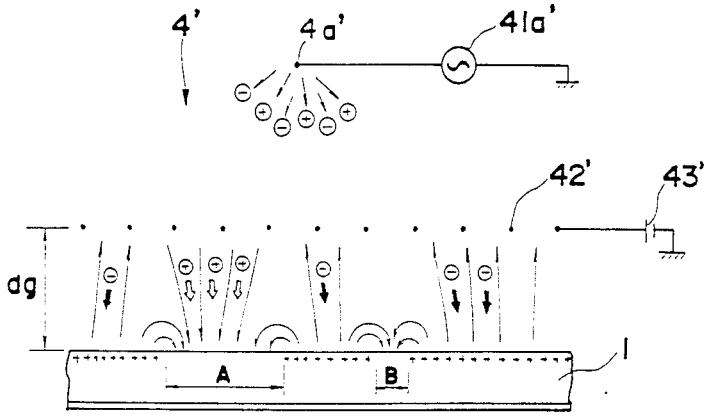

Further and more specifically describing in terms of drum surface potentials, those at peripheral outline portion A' of imaged area A and pattern-corresponding parts C of non-image area(s) remain at a low potential level substantially of +100 V, while those at light pass-allowed parts C of the non-image area(s) will be lowered substantially to grid voltage Vg or so and those residing at the substantial part of imaged area A will be caused to rise up nearly to grid voltage Vg or so, as shown at (a) of FIG. 26. In other words, surface potential at substantial area A and surface potential at light-pass allowed parts of the background will be subjected respectively to potential rise and drop to nearly +500 V by the application of ±6.0 kV to scorotron charger's voltage source 41*a'* and of +500 V to grid voltage source 43', respectively.

More specifically, also in the case of present fourth embodiment and in the second charging step, the background area(s) represents or represent a potential pattern consisting of an arrangement of finely divided and fine-pitched potentialized elements, while the substantial aprt of each imaged area A is statically charged, so as to provide when generally and representatively speaking, a positively charged static latent image pseudo-converted from a corresponding documentary image. Then, these latent images are subjected to a developing treatment as before, under the action of the developing unit 5'.

Developing conditions and developing mechanism adopted in the present embodiment are same as those which were adopted at (IV) and (V). Even if, in the present embodiment, the surface potentials at light-pass allowed parts of the non-image of static latent images should make a substantial drip nearly to grid voltage Vg, superfluous and foggy deposits of the toner could be positively suppressed as in the case of substantial and effective part of the latently imaged area A.

(Peripheral outline formation mode)

(i) First charging step

Operation and effect in this respect are same as in the foregoing reverse image formation mode.

(ii) Exposure step

Figure 28A:
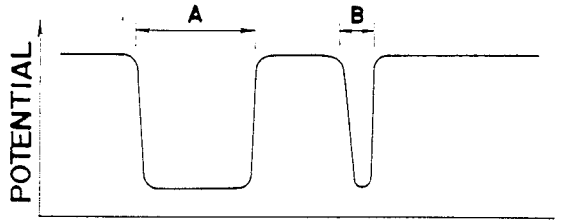
Figure 28B:
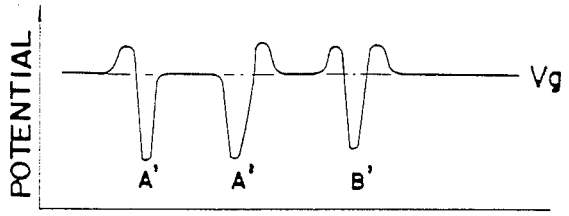
Figure 28C:
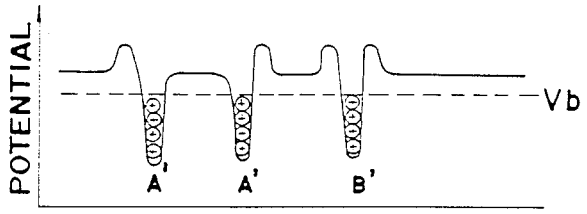

Without intermediary of pattern screen 31A, negative documentary images are slit-exposed for providing corresponding negative latent images (refer to at (a) of FIG. 28).

(iii) Second charging step

The drum surface 1 formed wth said negative latent images is subjected to a recharging step under the action of scorotron charger 4' supplied from voltage source 41*a'* with an alternating voltage.

Operational conditions of scorotron charger 4' are similar to those as adopted in the reverse image formation mode. However, appearance and details of the thus formed static latent images are different. More specifically, between drum surface 1 and grid 42', there are generated electric lines of force as shown schematically and only representatively by elongated arrows in FIG. 27. Negative and positive ions emanated from charge wire 4'*a* in FIG. 27 and fed with an alternating current from source 41*a'* are subjected to carrying forces along these electric lines of force. In this case, those electric lines which act to drive positive ions in proximity of grid 42' towards drum surface 1 are present, as in the case of the foregoing FIG. 25, exclusively in the range related with substantial and effective part of the imaged area(s) A. Thus, these positive ions impinge upon exclusively upon such substantial part above defined and potentialize the latter only, so as to elevate the potential(s) thereat nearly to such potential level which is substantially equal to grid voltage Vg. On the other hand, the negative ions will, as shown schematically and representatively by thickened arrows g, impinge upon the non-image area, however, devoid of outside zones of peripheral outlines A'; B' of imaged areas thereby the thus negative ion-impinged portions being subjected to a reduction in potential, and indeed, to a level substantially equal to grid voltage Vg.

More specifically, further describing in terms of drum surface potential, with reference to FIG. 28 at (b), the peripheral outlines A'; B' of imaged areas A; B will remain in low potential zones, each having a constant smaller width, substantially at +100 V, while outside zones of peripheral outlines A'; B', belonging to parts of the non-image area, are left remained in form of high potential parts, substantially equal to the initial surface potential of +600 V or so, and potentials at substantial parts of the background devoid of outside zones of peripheral outlines A'; B' will be decreased substantially to grid voltage Vg or so. On the other hand, the potential at substantial and effective part of areal image portion A or the like, will be subjected to potential rise to grid voltage Vg or so.

As a conclusion and in this way, upon execution of the second charging step, the peripheral outlines of imaged parts A;B have been thus formed in the required form of negatively charged static latent images.

(iv) Developing step

Operations are same as those adopted in the foregoing reverse image formation mode. In this case, positively charged insulative toner deposits on lower potential portions of the photosensitive drum surface 1 or more specifically at peripheral outline portions A'; B' and thus, the corresponding tonered images are formed and provided in the manner of "from-inside embroidering" by reliance of reverse image formation mode.

(Normal copying mode)

Operations are same as those which were adopted in the foregoing third embodiment and by taking such measures as receding the pattern screen 31A from position and without actuation of scorotron charger 4', and so on.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be contrued as being included therein.

What is claimed is:

1. A copying apparatus comprising:

first charging means for charging an electrostatic latent image bearing member to a predetermined potential;

exposing means for scanning an original document in a predetermined direction for exposing the document to the charged electrostatic latent image bearing member to form an electostatic latent image;

a screen member having a pattern of light blocking portions thereon and movable into and out of the light path between the exposing means and said image bearing member;

second charging means for recharging the electrostatic latent iamge formed on the electrostatic latent image bearing member, said second charging means having a grid;

developing means for developing the electrostatic latent image formed on the electrostatic latent image bearing member;

first mode designating means for designating a reversal image forming mode wherein a toner is deposited only onto a non-image portion of the latent image;

first control means to which said first mode designating means is connected and connected to said screen member for causing the screen member to move into the light path when the reversal image forming mode is designated by the first mode designating means; and second control means to which said first mode designating means is connected and connected to said second charging means for operating the second charging means when the reversal image forming mode is designated by the first mode designating means.

2. A copying apparatus as claimed in claim 1 wherein the pattern on said screen member has opaque colored lines formed on a transparent substrate and extending perpendicular to the scanning direction of the exposing means.

3. A copying apparatus as claimed in claim 1 wherein the pattern on said screen member has opaque colored mesh dots.

4. A copying apparatus as claimed in claim 2 further comprising means for supplying said grid with a voltage which is substantially lower than the surface potential at an image portion of the latent image and slightly higher than the surface potential at a non-image portion of the latent image and having a polarity the same as the polarity of the first charging means.

5. A copying apparatus as claimed in claim 4 wherein the developing means comprises means normally developing the electrostatic latent image with a toner charged to a polarity opposite to that of the first charging means.

6. A copying apparatus as claimed in claim 5 wherein the copying apparatus further comprises second mode designating means for designating an outline image forming mode wherein toner is deposited only on an outline portion of the latent image.

7. A copying apparatus as claimed in claim 6 wherein said second mode designating means is connected to said first control means and said first control means comprises means to control said screen member to withdraw said screen member from the light path when the outline image forming mode is designated by the second mode designating means.

8. A copying apparatus as claimed in claim 7 wherein the second control means comprises means for operating said second charging means when the outline image forming mode is designated by the second mode designating means.

9. A copying apparatus as claimed in claim 1 wherein the pattern on said screen member has lines which are capable of reflecting light formed on a transparent substrate and extending perpendicular to the scanning direction of the exposing means.

10. A copying apparatus as claimed in claim 1 wherein the pattern on said screen member has mesh dots capable of reflecting light.

11. A copying apparatus as claimed in claim 9 further comprising means for supplying said grid with a voltage which is substantially higher than the surface potential at an image portion of the latent image and slightly lower than the surface potential at a non-image portion of the latent image and having a polarity the same as the polarity of the first charging means.

12. A copying apparatus as claimed in claim 11 wherein the developing means comprises means for reversely developing the electrostatic latent image with a toner charged to a polarity the same as that of the first charging means.

13. A copying apparatus as claimed in claim 12 wherein the copying apparatus further comprises second mode designating means for designating an outline image forming mode wherein toner is deposited only on an outline portion of the latent image.

14. A copying apparatus as claimed in claim 13 wherein said second mode designating means is connected to said first control means and said first control means comprises means to control said screen member to withdraw said screen member from the light path when the outline image forming mode is designated by the second mode designating means.

15. A copying apparatus as claimed in claim 14 wherein the second control means comprises means for operating said second charging means when the outline image forming mode is designated by the second mode designating means.

16. A copying apparatus comprising:

first charging means for charging an electrostatic latent image bearing member to a predetermined potential;

exposing means for scanning a positive original document in a predetermined direction for exposing the document to the charged electrostatic latent image bearing member to form an electrostatic latent image;

a screen member having a pattern of opaque portions thereon and movable into and out of the light path between the exposing means and said image bearing member;

second charging means for recharging the electrostatic latent image formed on the electrostatic latent image bearing member, said second charging means having a grid and means to apply a voltage to said grid which is substantially lower than the surface potential at an image portion of the latent image and slightly higher than the surface potential at a non-image portion of the latent image and having a polarity the same as the polarity of the first charging means;

developing means for normally developing the electrostatic latent image formed on the electrostatic latent image bearing member with toner charged to a polarity opposite to that of the first charging means;

first mode designating means for designating a reversal image forming mode wherein a toner is deposited only onto a non-image portion of the latent image;

first control means to which said first mode designating means is connected and connected to said screen member for causing the screen member to move into the light path when the reversal image forming mode is designated by the first mode designating means; and second control means to which said first mode designating means is connected and connected to said second charging means for operating the second charging means when the reversal image forming mode is designated by the first mode designating means.

17. A copying apparatus as claimed in claim 16 wherein the pattern on said screen member is lines formed perpendicular to the scanning direction of the exposing means.

18. A copying apparatus comprising:

first charging means for charging an electrostatic latent image bearing member to a predetermined potential;

exposing means for scanning a negative original document in a predetermined direction for exposing the document to the charged electrostatic latent image bearing member to form an electrostatic latent image;

a screen member having a pattern of light reflecting portions thereon and movable into and out of the light path between the exposing means and said image bearing member;

second charging means for recharging the electrostatic latent image formed on the electrostatic latent image bearing member, said second charging means having a grid and means to apply a voltage to said grid which is substantially higher than the surface potential at an image portion of the latent image and slightly lower than the surface potential at a non-image portion of the latent image and having a polarity the same as the polarity of the first charging means;

developing means for normally developing the electrostatic latent image formed on the electrostatic latent image bearing member with toner charged to a polarity the same as that of the first charging means;

first mode designating means for designating a reversal image forming mode wherein a toner is deposited only onto a non-image portion of the latent image;

first control means to which said first mode designating means is connected and connected to said screen member for causing the screen member to move into the light path when the reversal image forming mode is designated by the first mode designating means; and second control means to which said first mode designating means is connected and connected to said second charging means for operating the second charging means when the reversal image forming mode is designated by the first mode designating means.

19. A copying apparatus as claimed in claim 18 wherein the pattern on said screen member is lines formed perpendicular to the scanning direction of the exposing means.

* * * * *